US006777628B2

(12) United States Patent
Azzola et al.

(10) Patent No.: US 6,777,628 B2
(45) Date of Patent: Aug. 17, 2004

(54) INTERLOCKING DEVICE FOR CIRCUIT BREAKERS

(75) Inventors: Lucio Azzola, Bergamo (IT); Osvaldo Carrara, Casnigo (IT)

(73) Assignee: ABB Service S.r.l. (IT)

( * ) Notice: Subject to any disclaimer, the term of this patent is extended or adjusted under 35 U.S.C. 154(b) by 0 days.

(21) Appl. No.: 10/451,218

(22) PCT Filed: Dec. 11, 2001

(86) PCT No.: PCT/EP01/14694

§ 371 (c)(1),
(2), (4) Date: Jun. 20, 2003

(87) PCT Pub. No.: WO02/50853

PCT Pub. Date: Jun. 27, 2002

(65) Prior Publication Data

US 2004/0045796 A1 Mar. 11, 2004

(30) Foreign Application Priority Data

Dec. 21, 2000 (IT) ..... MI2000A2791

(51) Int. Cl.[7] ..... H01H 9/20; H01H 11/00
(52) U.S. Cl. ..... 200/50.32; 335/157
(58) Field of Search ..... 200/50.23, 50.33, 200/43.16, 50.37, 5 B, 5 EA, 43.19; 335/157, 160

(56) References Cited

U.S. PATENT DOCUMENTS 3,319,020 A 5/1967 Shaffer
3,674,948 A * 7/1972 Betlejewski et al. ..... 200/50.33
5,008,499 A * 4/1991 Yee et al. ..... 200/50.33
5,393,942 A 2/1995 Reiner et al.
6,043,439 A 3/2000 Haag et al.
6,194,675 B1 * 2/2001 Greer ..... 200/50.32
6,563,063 B1 * 5/2003 Moore ..... 200/50.33

FOREIGN PATENT DOCUMENTS

JP 04248214 9/1992
JP 10106406 4/1998

* cited by examiner

*Primary Examiner*—Kyung Lee
(74) *Attorney, Agent, or Firm*—Connolly Bove Lodge & Hutz LLP

(57) ABSTRACT

A device for interlocking at least two single- or multipole circuit breakers, of which:—a first circuit breaker, suitable to be fixed to a mounting plate of the first and second circuit breakers; —a second circuit breaker, suitable to be fixed by virtue of fixing means to the first bracket and to be supported thereby;—an interlocking element, provided with a contoured body that is operatively coupled to the second bracket so that it can move with respect to it, the interlocking element being suitable to be rigidly connected to the second bracket, by virtue of locking means, in a chosen position in which it interacts operatively with at least the first opening/closure lever in a condition that corresponds to the opening of the first circuit breaker, preventing its movement and preventing the circuit breakers from being closed simultaneously.

27 Claims, 3 Drawing Sheets

INTERLOCKING DEVICE FOR CIRCUIT BREAKERS

The present invention relates to an interlocking device for low-voltage automatic circuit breakers, i.e., having operating voltages of up to approximately 1000 volts, with improved functions and characteristics.

Generally, low-voltage industrial electrical systems in which high-value currents, and therefore high power levels, are involved normally use specific devices, commonly known in the art as automatic or power circuit breakers. Said circuit breakers typically operate with DC or AC currents whose nominal value, depending on the applications, can vary over a wide range, typically from fractions of an ampere to several thousand amperes, and are conceived so as to provide a series of basic performance features in order to ensure the correct operation of the electrical system in which they are inserted and of the loads connected thereto.

In particular, they protect the loads from abnormal events caused by short-circuit faults or due to overloads by automatically opening the power supply circuit; they allow the correct insertion/disconnection of loads in/from the circuit; they ensure that the nominal current for the various connected users is truly equal to the required current; they allow, by manual intervention on a lever for the actuation of said circuit breaker and the corresponding separation of the movable contacts from the fixed contacts, the complete isolation of a load with respect to a power source and the consequent disconnection of the circuit that said circuit breakers protect.

In many practical applications, for example in use in automated industrial electrical systems, circuit breakers are required to perform additional functions that are auxiliary with respect to the basic ones that they normally perform; for this purpose, they are equipped with appropriate accessory devices that vary according to the type of auxiliary function to be performed.

One auxiliary function that is typically required in certain practical applications is known in the art as interlocking of two or more circuit breakers; this function is used when there are two or more electric circuits that operate in parallel to each other and cannot be closed simultaneously. For example, in the case of two electric circuits, the open condition of one of the two circuits while the other one is closed is maintained by acting manually on an appropriate interlocking device that is operatively associated with two circuit breakers, each inserted in the corresponding circuit; this device acts on the opening/closure mechanism of the circuit breaker associated with the circuit that must remain open and prevents any further movement thereof until further operator intervention occurs.

In the current state of the art, interlocking devices of the known type, despite adequately providing the required functional performance, have drawbacks and disadvantages.

In particular, a significant drawback of interlocking devices of the known art is the fact that in their typical form of application they are installed by fixing them directly to the front part or sides of the circuit breakers associated therewith. With this solution, it is therefore necessary to perforate, or even disassemble, the body of the circuit breakers and connect the device to the circuit breakers by using fixing means such as screws or pins that pass through the body of the circuit breakers and mate with them. This entails increased involvement and operating difficulties for workers, with a negative impact in terms of times and costs; moreover, the operations for perforation and for insertion of the fixing means can damage the circuit breakers and in any case entail a deterioration of active and/or structural parts during the useful lifetime of said circuit breakers. Moreover, with this conventional solution the means for fixing the interlocking device to the circuit breakers can be accessed directly even when one of the circuit breakers is closed; in this case, therefore, an inappropriate intervention on the part of an operator might lead to tampering with the interlocking device, with negative consequences as regards general safety conditions.

Moreover, solutions are known in the art in which at least one of the components of the interlocking device is fixed to the mounting plate on the opposite side with respect to the side on which the circuit breakers are mounted; these solutions entail an increase in volume and space occupation requirements and in any case generally require the use of components that pass through the body of the circuit breakers and interact with their mechanisms.

Finally, at least some of the known types of interlocking device cannot be used with circuit breakers having mutually different sizes.

The aim of the present invention is to provide a device for interlocking at least two circuit breakers that allows to obviate the drawbacks of the known art and in particular can be installed in a simplified manner and at the same time provides improved functional performance with respect to devices of the known type.

Within this aim, an object of the present invention is to provide a device for interlocking at least two circuit breakers that allows to avoid, during installation, interventions on the body of said circuit breakers, so as to prevent any damage thereto and/or avoid contributing, during their useful lifetime, to degradation of active and/or structural parts thereof.

Another object of the present invention is to provide a device for interlocking at least two circuit breakers that has, with respect to devices of the known type, a structure that is more compact and can also be used with circuit breakers of different sizes.

Another object of the present invention is to provide a device for interlocking at least two circuit breakers that allows to improve the general safety conditions of the entire electrical system in which it is used, eliminating completely or at least minimizing the possibilities of tampering, particularly when one of the circuit breakers is in the closed position.

Another object of the present invention is to provide a device for interlocking at least two circuit breakers that allows to reduce the difficulties and involvement faced by installation engineers, with a consequent benefit in terms of times and costs.

Another object of the present invention is to provide a device for interlocking at least two circuit breakers that is highly reliable, relatively easy to manufacture and at competitive costs.

This aim and these and other objects that will become better apparent hereinafter are achieved by a device for interlocking at least two single- or multipole circuit breakers, of which:

- a first circuit breaker having an enclosure that contains, for each pole, at least one fixed contact and one movable contact that can be operatively coupled/uncoupled with respect to each other, actuation means suitable to provide the energy required to move the movable contacts, and a first opening/closure lever that protrudes outside said enclosure;
- a second circuit breaker having an enclosure that contains, for each pole, at least one fixed contact and one movable contact that can be operatively coupled/uncoupled with respect to each other, actuation means suitable to provide the energy required to move the movable contacts, and a second opening/closure lever that protrudes outside said enclosure;

characterized in that it comprises at least:

a first supporting bracket, suitable to be fixed to a mounting plate of said first and second circuit breakers;

a second bracket, suitable to be fixed by virtue of fixing means to said first bracket and to be supported thereby;

an interlocking element, provided with a contoured body that is operatively coupled to said second bracket so that it can move with respect to it, said interlocking element being suitable to be rigidly connected to the second bracket, by virtue of locking means, in a chosen position in which it interacts operatively with at least said first opening/closure lever in a condition that corresponds to the opening of the first circuit breaker, preventing its movement and preventing the circuit breakers from being closed simultaneously.

In this manner, one has the advantage that the interlocking device according to the invention is mounted directly on the mounting plate of the circuit breakers and allows to lock at least one of them in the open position, by acting on the opening/closure lever and therefore externally with respect to the enclosure, without having to perforate or disassemble the body of the circuit breakers.

Further characteristics and advantages of the invention will become better apparent from the description of a preferred but not exclusive embodiment of an interlocking device according to the invention, illustrated only by way of non-limitative example with the aid of the accompanying drawings, wherein.

Figure 4:
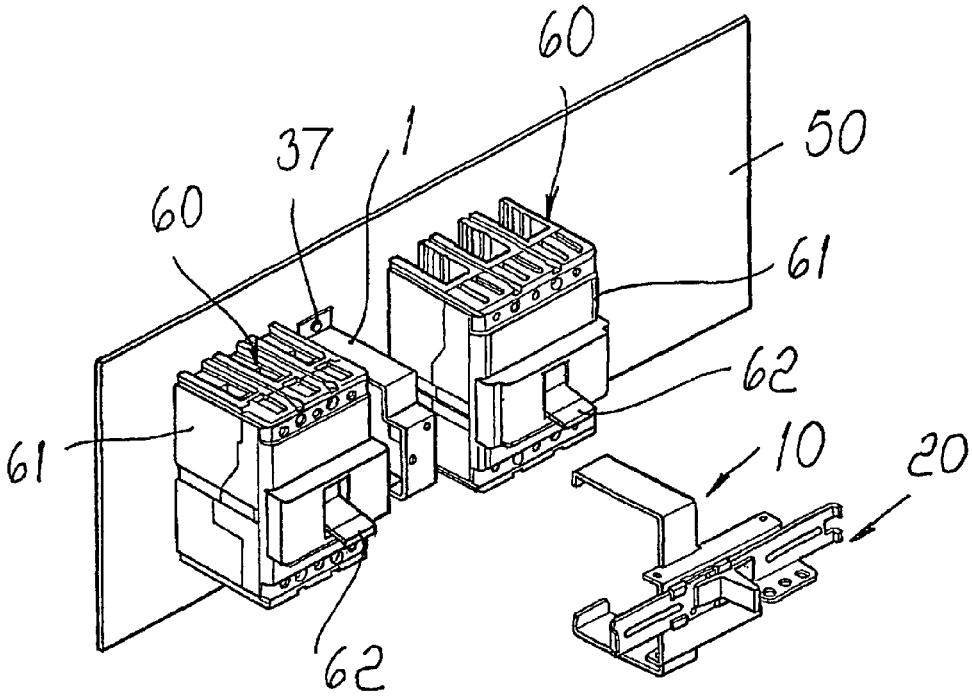
FIG. 4 is a perspective view of the elements of FIGS. 1 and 2 during installation with a pair of automatic circuit breakers.
Figure 5:
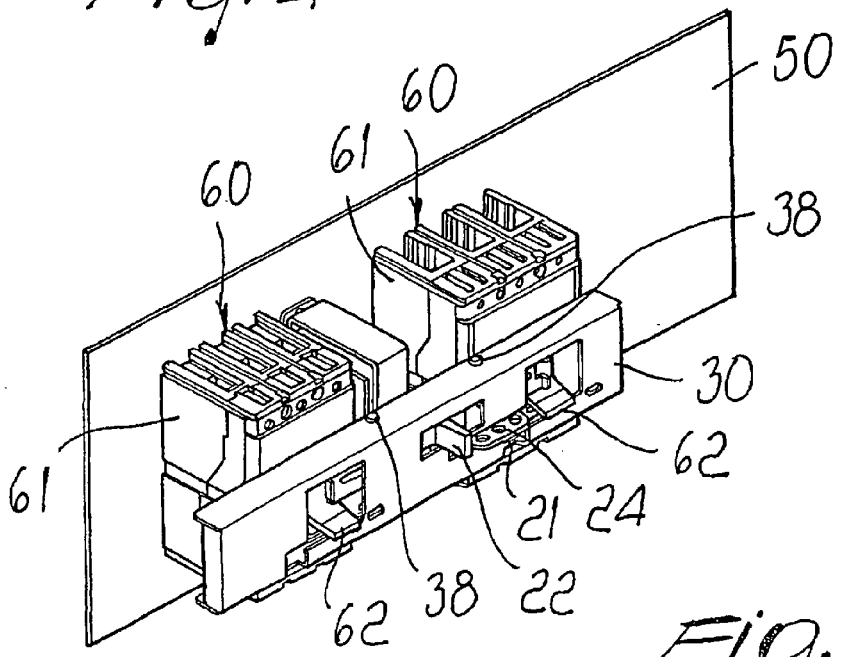
FIG. 5 is a view of the interlocking device according to the invention, operatively associated with a pair of automatic circuit breakers in the open position.
Figure 6:
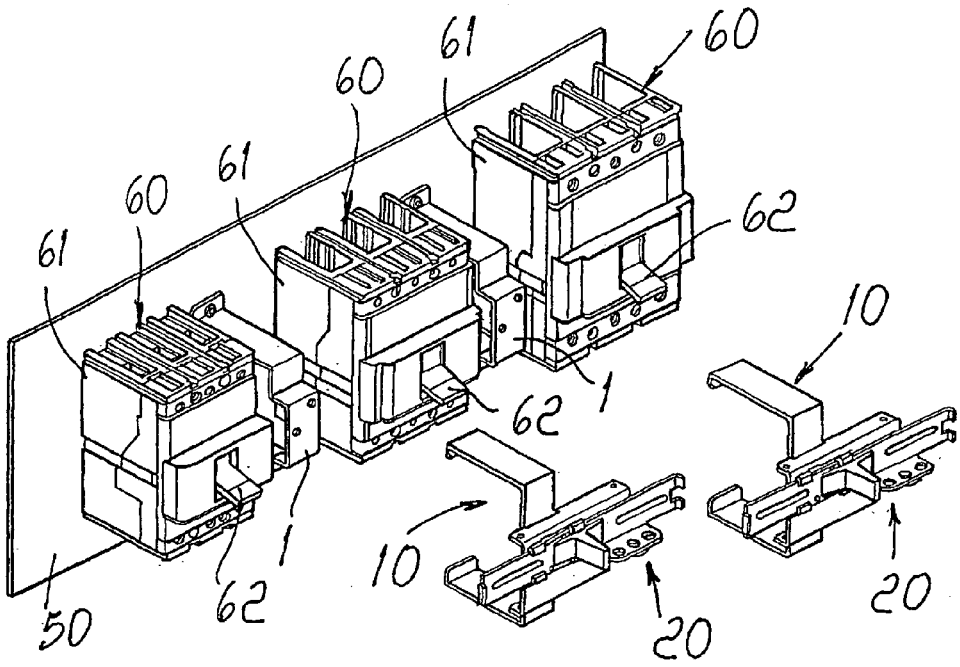
FIG. 6 is a view of another embodiment of a device according to the invention, for interlocking three circuit breakers.

With reference to the above cited figures, the interlocking device according to the invention comprises a first supporting bracket 1 that is suitable to be fixed to a mounting plate 50 of at least one pair of single- or multipole circuit breakers 60, shown in detail in FIGS. 4–6; in particular, FIGS. 4 and 5 illustrate a pair of multipole automatic circuit breakers 60, whereas FIG. 6 shows three circuit breakers 60. Said circuit breakers 60, according to embodiments that are widely known in the art and therefore are not illustrated in detail, comprise, also in the single-pole version, an enclosure 61 that contains, for each pole, at least one fixed contact and one movable contact that can be operatively coupled/uncoupled with respect to each other, actuation means suitable to provide the energy required to move the movable contacts and produce their coupling/uncoupling with respect to the corresponding fixed contacts, and an opening/closure lever 62 that protrudes outside said enclosure 61.

Figure 2:
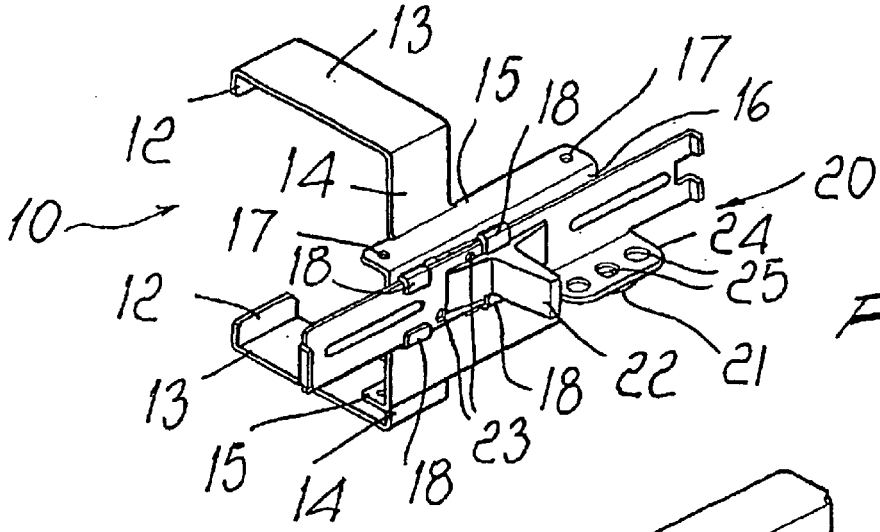
FIG. 2 is a perspective view of a second bracket and of an interlocking element, coupled to each other and used in the device according to the invention.

In the embodiment of the interlocking device according to the invention, the supporting bracket 1 has at least one first surface that is provided with a hole suitable to accommodate means for fixing to the mounting plate 50, at least one second surface that is arranged transversely to the first surface and forms at least one supporting surface for a second bracket designated by the reference numeral 10 in FIG. 2, and at least one third surface that protrudes transversely from the second surface and is provided with holes suitable to receive means, typically screws, for fixing to the second bracket 10.

Figure 1:
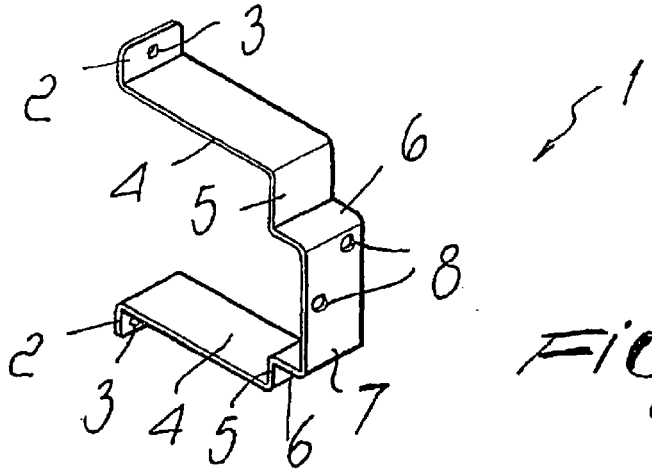
FIG. 1 is a perspective view of a supporting bracket used in the device according to the invention.

In particular, as shown in detail in FIG. 1, the supporting bracket 1 preferably comprises a first end portion and a second end portion that are L-shaped when viewed laterally, each one of the short arms 2 of the L-shape being provided with a hole 3 for fixing to the plate 50, the long arms 4 being parallel to each other; furthermore, the bracket 1 has a third portion that connects the long sides 4 of the first and second portions. Said third portion, viewed laterally, is substantially shaped like a square wave, with first and second walls 5 that protrude at right angles from the corresponding long arms 4, third and fourth walls 6 that protrude at right angles from the walls 5 and form the sides of the square waves, and a fifth wall 7 that mutually connects the walls 6 and is perpendicular thereto; the wall 7 constituted the base wall of the square wave and is provided with holes 8 for fixing to the second bracket 10.

In turn, the second bracket 10 has at least one surface for contact with the supporting bracket 1 and at least one second surface in which there are holes suitable to receive means for fixing to said first bracket 1 and to a covering element, designated by the reference numeral 30 in FIG. 3; the bracket 10 is furthermore provided with means for guiding an interlocking element, designated by the reference numeral 20 in FIG. 2, for the purposes described hereinafter.

In the embodiment illustrated in FIG. 2, the bracket 10 also preferably has first and second end portions which, when viewed laterally, are L-shaped, with short arms 12 arranged so as to converge toward each other and long arms 13 arranged parallel to each other, and a third portion that mutually connects the long arms 13. Said third portion of the second bracket 10, when viewed laterally, is also substantially shaped like a square wave, with first and second walls 14 that protrude at right angles from the corresponding long arms 13, third and fourth walls 15 that protrude at right angles from the walls 14 and form the sides of the square wave, and a fifth wall 16 that constitutes the central wall of the square wave and mutually connects the walls 15. The side walls 15 are provided with holes 17 for fixing to the covering element 30, while the central wall 16 is provided with additional holes (not shown in the figure) for fixing to the first supporting bracket 1; furthermore, on the central wall 16 and on the opposite side with respect to the side walls 15 there are preferably two pairs of protruding hooks 18 that are arranged so as to face each other and mate with corresponding edges of the interlocking element 20, so as to facilitate its guided sliding for the purposes described hereinafter, and there is a protruding wall 21, shown only partially in FIG. 2, that is provided with holes suitable to receive means, typically a lock, for locking with respect to the covering element 30.

As shown in FIG. 2, the interlocking element 20 has preferably a substantially rod-like body that has, in a substantially central position, means 22 for gripping said body, and two holes 23 suitable to facilitate the passage of the screws for fixing the first supporting bracket 1 to the second bracket 10; furthermore, the element 20 is provided with a protruding wall 24 that has holes 25, protrudes from the rod-like body substantially at right angles thereto, and is suitable to couple to the protruding wall 21 by virtue of the locking means.

Figure 3:
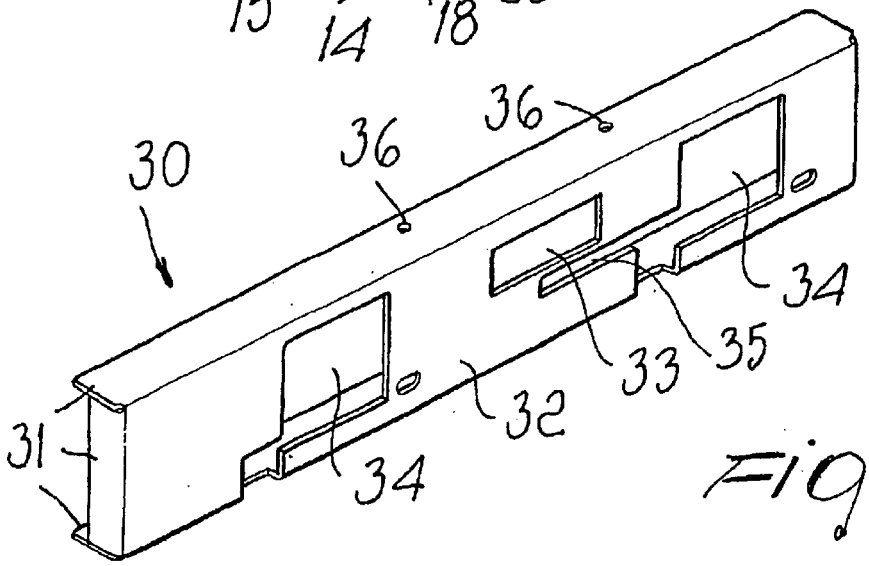
FIG. 3 is a perspective view of a covering element used in the device according to the invention.

As shown in FIG. 3, the covering element 30 has preferably a plate-like body with edges 31 that are folded with respect to the central portion 32 of said body; in said central portion 32 there is a cutout 33, suitable to accommodate the means 22 for gripping the bracket 10, and there are two openings 34, arranged on opposite sides with respect to the cutout 33 and each suitable to accommodate a lever 62 for opening/closing one of the two circuit breakers 60. Furthermore, in the central portion 32 there is at least one slot 35 that is suitable to accommodate the protruding walls 21 and 24, and on at least one pair of the folded edges 31 there are holes 36 suitable to accommodate means, typically screws, for fixing to the second bracket 10.

The assembly and practical use of the interlocking device according to the invention are now described with particular reference to FIGS. 4 and 5.

First of all, the supporting bracket 1 is fixed to the mounting plate 50 so that the short arms 2 that are fixed to the plate 50 diverge from each other, by virtue of screws 37 that engage the holes 3, and so that the long arms 4 are parallel and protrude away from the plate 50; advantageously, in the embodiment of the device according to the invention, the supporting bracket 1 is mounted on the same face of the plate 50 on which the two circuit breakers 60 are mounted and is interposed between them. Then the second bracket 10 is coupled to the interlocking element 20. In particular, the interlocking element 20 is operatively coupled to the second bracket 10, so that it can move with respect to it, by virtue of the pairs of hooks 18 that engage two opposite edges of said interlocking element 20; in this manner, the pairs of hooks 18 constitute, for the interlocking element 20, two rails that facilitate its guided sliding with respect to the bracket 10. The resulting assembly constituted by the bracket 10 and the element 20 is coupled to the supporting bracket 1, so that the bracket 10 surrounds the bracket 1 and is supported thereby; in particular, the bracket 10 is arranged so that its short arms 12 rest on the long arms 4 and so that the walls 14–16 of the square wave-shaped portion mate geometrically with the correspondingly complementarily shaped walls 5–7 of the square wave-shaped portion of the bracket 1. Then the bracket 10 is fixed to the supporting bracket 1 by virtue of screws that pass through the holes 23 of the element 10 and engage the holes 8 of the bracket 1 and the holes formed in the wall 16 of the bracket 10. Finally, as shown in FIG. 5, the covering element 30 is arranged by fixing it to the second bracket 10, so that the grip means 22 are accommodated in the cutout 33, the two levers 62 are accommodated in the corresponding openings 34, and the protruding walls 21 and 24 pass through the slot 35; the covering element 30 is fixed to the bracket 10 by virtue of screws 38 that engage the holes 36 and 17. In this manner, the element covers the screws for mutually fixing the two brackets 1 and 10 and prevents direct access thereto.

Once the various components of the interlocking device have been assembled, an operator can act on the grip means 22, making the element 20 slide with respect to the brackets 1 and 10 until it is arranged alternately in a first position, in which a first end surface of its body interacts with a first opening/closure lever 62, preventing its movement when the corresponding circuit breaker 60 is open, or in a second position, in which a second end surface of its body interacts with the other opening/closure lever 62, preventing its movement when the second circuit breaker is open, or in a third position, shown in FIG. 5, in which the two end surfaces interact with both opening/closure levers 62, preventing their movement, when the circuit breakers 60 are open. In this manner, the interlocking element 20 interacts operatively with at least one of the two opening/closure levers 62, preventing the movement thereof and preventing the circuit breakers 60 from being closed simultaneously. Once the intended position has been reached, the element 20 is rigidly locked to the bracket 10 by means of a padlock, not shown, which engages the holes formed in the protruding walls 21 and 24.

In practice it has been found that the interlocking device according to the invention fully achieves the intended aim and objects, allowing to obviate the drawbacks of the prior art and providing a significant series of advantages.

In fact, as mentioned, the device according to the present invention, by virtue of the structure and operation of its constructive components, allows to perform the interlocking function in an extremely effective manner, without requiring interventions to perforate or disassemble the body of the circuit breakers and with consequent benefits in terms of difficulty, times and costs of intervention of workers, also avoiding damage to the circuit breakers or any contribution to their degradation. Furthermore, the fact that the device is installed on the circuit breaker mounting plate, on the same face on which said circuit breakers are arranged and so that the bracket 1 is interposed between them, allows to have a configuration that is compact, has a smaller space occupation than known types of device, and is aesthetically improved. This, as an additional advantage, leads to the fact that indeed by virtue of its constructive compactness interventions on the degree of protection of the circuit breaker-device assembly are greatly facilitated.

The presence of the covering element 30, which covers the means for mutually fixing the two brackets 1 and 10 and prevents access to them, allows to exclude or at least considerably limit the possibility of inappropriate interventions that tamper with the device, consequently improving general safety conditions.

Furthermore, by virtue of its constructive structure, the device allows to lock both circuit breakers in the open position and can also be used with circuit breakers of mutually different sizes, without requiring particular structural modifications of its components or variations during their installation.

Figure 7:
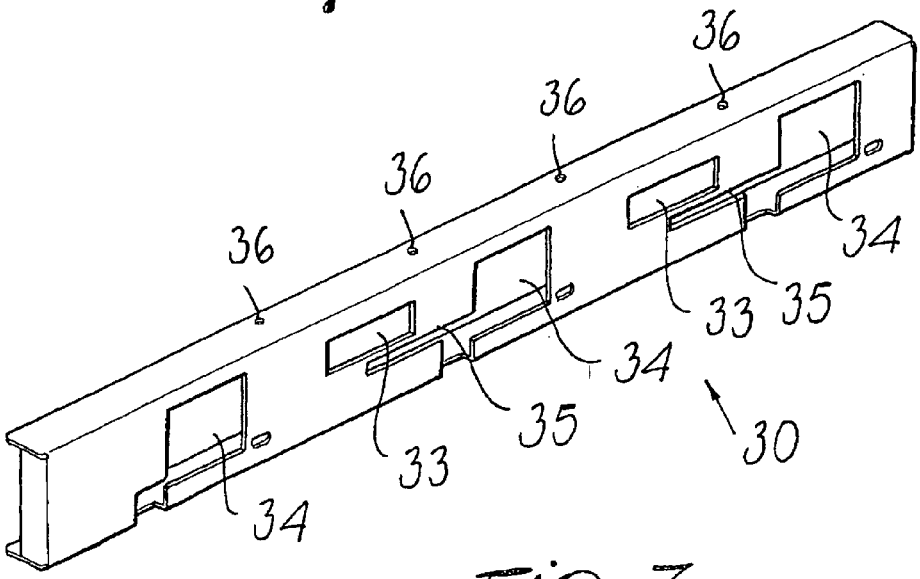
FIG. 7 is a view of a covering element that can be used in the device of FIG. 6.

Moreover, one cannot ignore the fact that the device thus conceived can be used easily even if more than two circuit breakers are to be interlocked. A constructive example is shown, in this regard, in FIG. 6, in which there are three circuit breakers 60. In this case, the device uses two supporting brackets 1, each mounted on the plate 50 interposed between two contiguous circuit breakers 60; a bracket 10 and an interlocking element 20 are then coupled to each one of these brackets 1. The entire assembly is completed by using a covering element 30 which, as shown in FIG. 7, with respect to the solution with two circuit breakers has a second cutout 33 for coupling to the grip means of the second interlocking element 20, an additional cutout 34 for coupling to the lever for opening/closing the third circuit breaker, and a second slot 35 for coupling to the protruding walls 21 and 24 of the second bracket 10 and of the second interlocking element 20. Accordingly, an additional aspect of the present invention is constituted by a device for interlocking three single- or multipole circuit breakers, namely:

- a first circuit breaker and a second circuit breaker 60 as described above;

a third circuit breaker 60, having an enclosure 61 that contains, for each pole, at least one fixed contact and one movable contact that can be mutually operatively coupled/uncoupled, actuation means suitable to provide the energy required to move the movable contacts, and an opening/closure lever 62 that protrudes outside said enclosure;

characterized in that it comprises at least:

a first and a second supporting bracket 1;

a first and a second bracket 10, each coupled to a corresponding bracket 1;

a first and a second interlocking element 20, each coupled to a bracket 10; and a covering element 30, which has a plate-like body with folded edges, first and second cutouts being formed in the central part of said plate-like body and being suitable to accommodate respectively the grip means of said first and second interlocking elements, three openings arranged in pairs on opposite sides with respect to the cutouts and suitable to accommodate the corresponding levers for opening/closing the circuit breakers, and at least one first and second slot that are suitable to accommodate said first and second protruding walls of the supporting brackets and of the interlocking elements, holes being furthermore provided on said folded edges so as to accommodate means for fixing to said first and second brackets.

The device thus conceived is susceptible of modifications and variations, all of which are within the scope of the inventive concept; all the details may furthermore be replaced with technically equivalent elements. In practice, the materials used, so long as they are compatible with the specific use, as well as the dimensions, may be any according to requirements and to the state of the art.

What is claimed is:

1. A device for interlocking at least two single- or multipole circuit breakers, the circuit breakers comprising:

a first circuit breaker having an enclosure that contains, for each pole, at learns one fixed contact and one movable contact that can be operatively coupled/uncoupled with respect to each other, actuation means suitable to provide the energy required to move the movable contacts, and a first opening/closure lever that protrudes outside said enclosure; and a second circuit breaker having an enclosure that contains, for each pole, at least one fixed contact and one movable contact that can be operatively coupled/uncoupled with respect to each other, actuation means suitable to provide the energy required to move the movable contacts, and a second opening/closure lever that protrudes outside said enclosure, wherein the device comprises:

a first supporting bracket, suitable to be fixed to a mounting plate of said first and second circuit breakers;

a second bracket, suitable to be fixed by virtue of fixing means to said first supporting bracket and to be supported thereby; and an interlocking element, provided with a contoured body that is operatively coupled to said second bracket so that it can move with respect to it, said interlocking element being suitable to be rigidly connected to the second bracket, by virtue of locking means, in a chosen position in which it interacts operatively with at least said first opening/closure lever in a condition that corresponds to the opening of the first circuit breaker, preventing its movement and preventing the first and second circuit breakers from being closed simultaneously.

2. An interlocking device according to claim 1, wherein said interlocking element is coupled in a slidingly guided manner to said second bracket and can be rigidly connected thereto, by virtue of said locking means, either in a first position, in which a first end surface interacts with said first opening/closure lever, preventing its movement when the first circuit breaker is open, or in a second position, in which a second end surface interacts with said second opening/closure lever, preventing its movement when the second circuit breaker is open, or in a third position, in which said first and second end surfaces interact with said first and second opening/closure levers, preventing their movement, when the first and second circuit breakers are open.

3. The interlocking device according to claim 2, comprising: a covering element that is suitable to be fixed to said second bracket so as to cover the means for fixing the first bracket to the second bracket and prevent direct access thereto.

4. The interlocking device according to claim 2, wherein said first supporting bracket and said first and second is circuit breakers are mounted on the same face of the plate with the first bracket arranged between the two circuit breakers.

5. The interlocking device according to claim 2, wherein said first supporting bracket has at least one first surface, which is provided with a hole that is suitable to accommodate means for fixing to said mounting plate, at least one second surface, which is arranged transversely to the first surface and forms at least one supporting surface for said second bracket, and at least one third surface, which protrudes transversely from the second surface and is provided with holes suitable to receive means for fixing to said second bracket.

6. The interlocking device according to claim 2, wherein said second bracket has at least one surface for contact with said first bracket, at least one second surface in which there are holes suitable to receive means for fixing to the first bracket and to the covering element, and means for guiding said interlocking element.

7. The interlocking device according to claim 1, comprising; a covering element that is suitable to be fixed to said second bracket so as to cover the means for fixing the first bracket to the second bracket and prevent direct access thereto.

8. The interlocking device according to claim 7, wherein said covering element has a plate-like body with folded edges, in the central part of which there is a cutout suitable to accommodate said grip means and there are two openings arranged on opposite sides with respect to the cutout and suitable to respectively accommodate said first and second opening/closure levers and at least one slot suitable to accommodate said first and second protruding walls, holes being furthermore provided on said folded edges and being suitable to accommodate means for fixing to the second bracket.

9. The interlocking device according to claim 7, wherein the first supporting bracket and said first and second is circuit breakers are mounted on the same face of the plate with the first bracket arranged between the two circuit breakers.

10. The interlocking device according to claim 7, wherein said first supporting bracket has at least one first surface, which is provided with a hole that is suitable to accommodate means for fixing to said mounting plate, at least one second surface, which is arranged transversely to the first surface and forms at least one supporting surface for said second bracket, and at least one third surface, which protrudes transversely from the second surface and is provided with holes suitable to receive means for fixing to said second bracket.

11. The interlocking device according to claim 7, wherein said second bracket has at least one surface for contact with said first bracket, at least one second surface in which there are holes suitable to receive means for fixing to the first bracket and covering element, and means for guiding said interlocking element.

12. The interlocking device according to claim 1, wherein said first supporting bracket and said first and second circuit breakers are mounted on the same face of the plate with the first bracket arranged between the two circuit breakers.

13. The interlocking device according to claim 12, wherein said first supporting bracket has at least one first surface, which is provided with a hole that is suitable to accommodate means for fixing to said mounting plate, at least one second surface, which is arranged transversely to the first surface and forms at least one supporting surface for said second bracket, and at least one third surface, which protrudes transversely from the second surface and is provided with holes suitable to receive moans for fixing to said second bracket.

14. The interlocking device according to claim 1, wherein said first supporting bracket has at least one first surface, which is provided with a hole that is suitable to accommodate means for fixing to said mounting plate, at least one second surface, which is arranged transversely to the first surface and forms at least one supporting surface for said second bracket, and at least one third surface, which protrudes transversely from the second surface and is provided with holes suitable to receive means for fixing to said second bracket.

15. The interlocking device according to claim 14, wherein said first bracket comprises a first end portion and a second end portion, which are L-shaped, the short arms of the L-shape being perforated and fixed to the plate so as to mutually diverge, the long arms being arranged parallel to each other and orientated away from the plate, and a third portion, which is substantially shaped like a square wave and connects said long arms of the first and second portions, the central wall of the square wave being arranged substantially parallel to said short sides and being provided with holes for fixing to the second bracket.

16. The interlocking device according to claim 14, wherein said second bracket has fourth and fifth L-shaped end portions, in which the short arms are arranged so as to mutually converge and rest on the long arms of said first and second portions and the long arms are parallel and directed away from the plate, and a sixth portion, which is shaped like a square wave and mates geometrically with the complementarily shaped walls of said third portion, the side walls of said sixth square-wave portion being provided with holes for fixing to the covering clement, the central wall being provided with holes for fixing to the first supporting bracket.

17. The interlocking device according to claim 14, wherein said second bracket further has, on the central wall of said sixth square-wave portion and on the opposite side with respect to the side walls, protruding hooks that face each other and mate with corresponding edges of the interlocking element, so as to facilitate its guided sliding and subsequent positioning in the intended position, a first protruding and perforated wall furthermore protruding from said end wall substantially at right angles thereto and being suitable to receive means for locking with said covering element.

18. The interlocking device according to claim 1, wherein said second bracket has at least one surface for contact with said first bracket, at least one second surface in which there are holes suitable to receive means for fixing to the first bracket and to the covering element, and means for guiding said interlocking element.

19. The interlocking device according to claim 1, wherein said interlocking element comprises a rod-like body which has, in a substantially central position, means for gripping said body and two holes suitable to facilitate the passage of the means for mutually fixing said first and second brackets, a second protruding and perforated wall protruding from said rod-like body substantially at right angles thereto, said second wall being suitable to mate with said first protrusion by virtue of said locking means.

20. The interlocking device according to claim 1, wherein the first supporting bracket comprises:

at least one long arm and at least one wall connected to the at least one long arm, wherein the at least one long arm offsets the at least one wall from the mounting plate when the first supporting bracket is fixed to the mounting plate.

21. The interlocking device according to claim 20, wherein the second bracket comprises:

at least one long arm, wherein the at least one long arm of the second bracket extends substantially parallel with the at least one long arm of the first supporting bracket when the second bracket is fixed to the first supporting bracket.

22. The interlocking device according to claim 20, wherein the at least one long arm of the first supporting bracket extends in a first direction and the interlocking element moves in a direction that is generally perpendicular to the first direction.

23. The interlocking device according to claim 1, wherein the interlocking element comprises:

a rod-like body; and grip means, wherein the interlocking element is movable with respect to the second bracket in a direction along a length of the rod-like body, and wherein the grip means extends outwardly for the rod-like body.

24. The interlocking device according to claim 23, comprising:

a covering element having a first cutout and a second cutout, wherein the grip means extends through the first cutout.

25. The device for interlocking at least one pair of single- or multipole circuit breakers, according to claim 1 having:

a first circuit breaker;

a second circuit breaker, a third circuit breaker having an enclosure that contains, for each pole, at least one fixed contact and one movable contact that can be operatively coupled/uncoupled with respect to each other, actuation means suitable to supply the energy required to move the movable contacts, and a third opening/closure lever that protrudes outside said enclosure; wherein the device comprises at least:

a first and a second supporting bracket;

a first and a second bracket;

a first and a second interlocking element; and a covering element that has a plate-like body with folded edges, the central part of which is provided with a first cutout and a second cutout that are suitable to accommodate respectively the grip means of said first and second interlocking elements, three openings arranged in pairs on opposite sides with respect to the cutouts and suitable to accommodate the corresponding opening/closure levers of the circuit breakers, and at least one first slit and one second slit, which are suitable to accommodate said first and second protruding walls of the supporting brackets and the interlocking elements, holes being furthermore provided on said folded edges so as to accommodate means for fixing to said first and second brackets.

26. A device for interlocking at least two single- or multipole circuit breakers, comprising:

a first supporting bracket having at least one long arm and at least one wall connected to the at least one long arm;

a first bracket having at least one long arm, wherein the at least one long arm of the first bracket extends substantially parallel with the at least one long arm of the first supporting bracket when the first bracket is fixed to the first supporting bracket;

a first interlocking element having an elongate body operatively coupled to the first bracket and movable with respect to the first bracket in a direction along a length of the elongate body, wherein the first interlocking element comprises first grip means that extend outwardly from the elongate body; and a covering element having a first cutout and a second cutout, wherein the first grip means extends through the first cutout and is movable in a direction along a length of the elongate body within the first cutout.

27. The device of claim 26, comprising:

a second supporting bracket having at least one long arm and at least one wall connected to the at least one long arm;

a second bracket having at least one long arm, wherein the at least one long arm of the second bracket extends substantially parallel with the at least one long arm of the second supporting bracket when the second bracket is fixed to the second supporting bracket; and a second interlocking element having an elongate body operatively coupled to the second bracket and movable with respect to the second bracket in a direction along a length of the elongate body, wherein the second interlocking element comprises second grip means that extend outwardly from the elongate body, wherein the second grip means extends through the second cutout.

* * * * *